United States Patent [19]

Palumbo

[11] Patent Number: 4,505,575

[45] Date of Patent: Mar. 19, 1985

[54] NON-IMAGE ERASE SYSTEM FOR REPRODUCTION MACHINES

[75] Inventor: Stephen A. J. Palumbo, Rochester, N.Y.

[73] Assignee: Xerox Corporation, Stamford, Conn.

[21] Appl. No.: 526,923

[22] Filed: Aug. 26, 1983

[51] Int. Cl.[3] ..... G03G 15/00

[52] U.S. Cl. ..... 355/14 E; 355/75

[58] Field of Search ..... 355/14 E, 14 ER, 3 R, 355/3, 14 R, 35 H, 7 S, 8

[56] References Cited

U.S. PATENT DOCUMENTS

| | | | |
|---|---|---|---|
| 3,642,371 | 2/1972 | Jones et al. | 355/128 |
| 3,724,940 | 4/1973 | Koizumi | 355/3 R |
| 3,724,942 | 4/1973 | Gibson et al. | 355/3 |
| 3,834,807 | 9/1974 | Fuller et al. | 355/3 R |
| 4,368,973 | 1/1983 | Silverberg | 355/3 SH |

OTHER PUBLICATIONS

IBM Technical Disclosure Bulletin, vol. 17, Aug. 1974, pp. 678–679.

*Primary Examiner*—A. T. Grimley
*Assistant Examiner*—David Warren
*Attorney, Agent, or Firm*—Frederick E. McMullen

[57] ABSTRACT

A xerographic type reproduction machine having a photoreceptor, a platen for supporting a document to be copied, an exposure lamp, and optical means for transmitting image rays from the platen and the document thereon to the photoreceptor to create a latent electrostatic image of the document on the photoreceptor; an edge erase lamp, means forming a fiber optic type conduit for transmitting a band of light from the erase lamp onto the photoreceptor to erase any non-image areas adjoining the edge of the latent image, a movable shutter when disposed in a home position closes the fiber optic conduit and prevent exposure of the photoreceptor to the erase lamp whereby to obviate possible deterioration of the photoreceptor from excessive exposure by the erase lamp; a cover for the platen having a highly reflective interior; and control means responsive to the closure of the cover to retain the shutter in park position and rely on light reflected from the cover interior during exposure to erase the non-image areas without exposing the photoreceptor to the erase lamp, the control means responding to a reduction in image size to move the shutter in accordance with either the size of the copy sheets in process or the reduced image size so that light from the erase lamp is used to discharge the photoreceptor non-image area resulting from the reduction in image size, the control means further responding to disposition of the cover in an inoperative position to move the shutter in accordance with the size of the copy sheets in process to erase any photoreceptor non-image area with light from the erase lamp.

6 Claims, 14 Drawing Figures

NON-IMAGE ERASE SYSTEM FOR REPRODUCTION MACHINES

The invention relates to a system for erasing non-image areas on the photoreceptor of a xerographic type reproduction machine or printer, and more particularly, to an erasure system in which light from the document exposure lamp or lamps is normally used for this purpose with provision for use of a separate erase lamp in special operating circumstances.

In reproduction machines or printers of the xerographic type, a latent electrostatic image of the original being reproduced or copied is formed on the photoconductive surface of machine photoreceptor. Thereafter, the latent electrostatic image is developed and transferred to a copy sheet. The transferred image is then fixed as by fusing to provide a permanent copy.

In the aforedescribed process, certain areas of the photoreceptor, although conditioned for imaging, are unused. Some of these non-image areas occur before the first image in a series, between successive images, and after the last image in a series, and these are referred to collectively as the interdocument area. Other non-image areas, referred to as side edge areas, occur in the areas bordering the top and bottom edges of the image. Further, as will be understood by those skilled in the xerographic arts, the size of some or all of these non-image areas changes with changes in the size of the image produced. For example, where a reduced size image is made, the interdocument area and one or both of the side edge areas increase in size.

Typically, in the case of the aforementioned interdocument areas, an exposure lamp is provided across the photoreceptor path, the lamp, which is normally referred to as an interdocument erase lamp, being exercised for brief moments in timed relation with movement of the photoreceptor and the placement of the latent electrostatic images thereon to erase the interdocument areas. To accommodate changes in image size, which as noted work to change the extent of the interdocument areas, a control is normally provided to operate the interdocument erase lamp for a time span associated with the size of the image currently being produced.

However, erasure of the side edge areas is offtimes more difficult to achieve since the physical size or span of the erase light must be changed to accommodate changes in image size. In the past, multiple lamps of different size have been used as well as movable shutters to provide erase light whose extent is tailored to the image size. A further complication may also arise, namely, fatigue of the photoreceptor sections which are exposed to the erase lamp. Since normally the edge erase lamp or lamps, once adjusted for proper size as by setting a shutter or shutters, are held on continuously, the constant and sustained exposure of portions of the photoreceptor to light from the edge erase lamp or lamps, which to assure discharge are relatively bright, may fatigue the photoreceptor in these areas and result in premature failure of the photoreceptor areas exposed to the lamp or at least impairment of its operating properties.

To overcome the above problems, there is provided a reproduction machine having at least one erase lamp for discharging unused non-imaged areas of the machine photoreceptor, a transparent platen for the document to be copied, at least one high intensity exposure lamp for illuminating the document to be copied on the platen, and a cover member for covering the entire platen when making copies to prevent escape of extraneous light, the cover member presenting a highly reflective surface to the platen adapted to reflect light from the exposure lamp escaping past the document being copied on the platen back to the photoreceptor whereby to discharge the non-imaged areas without using the erase lamp.

IN THE DRAWINGS

Figure 10A:
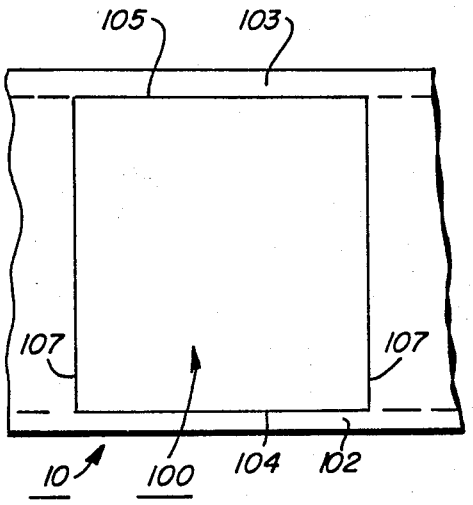
Figure 10B:
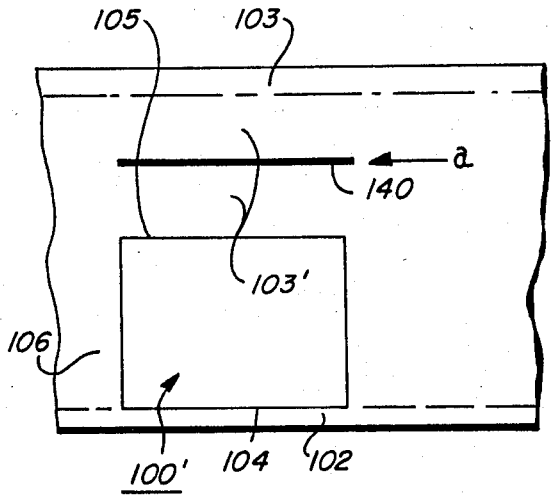
Figure 10C:
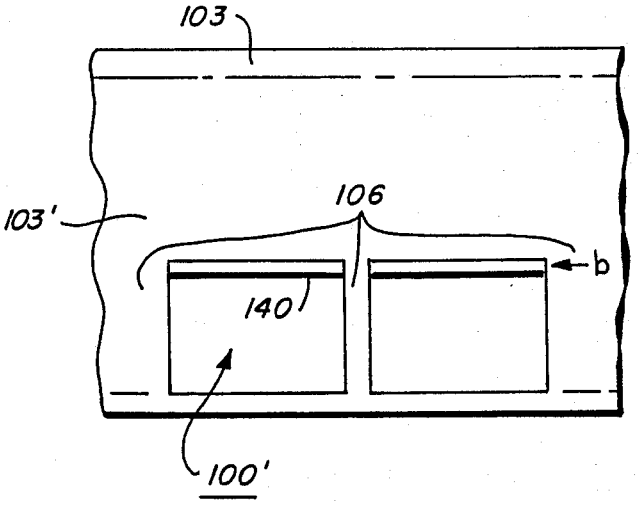
Figure 11A:
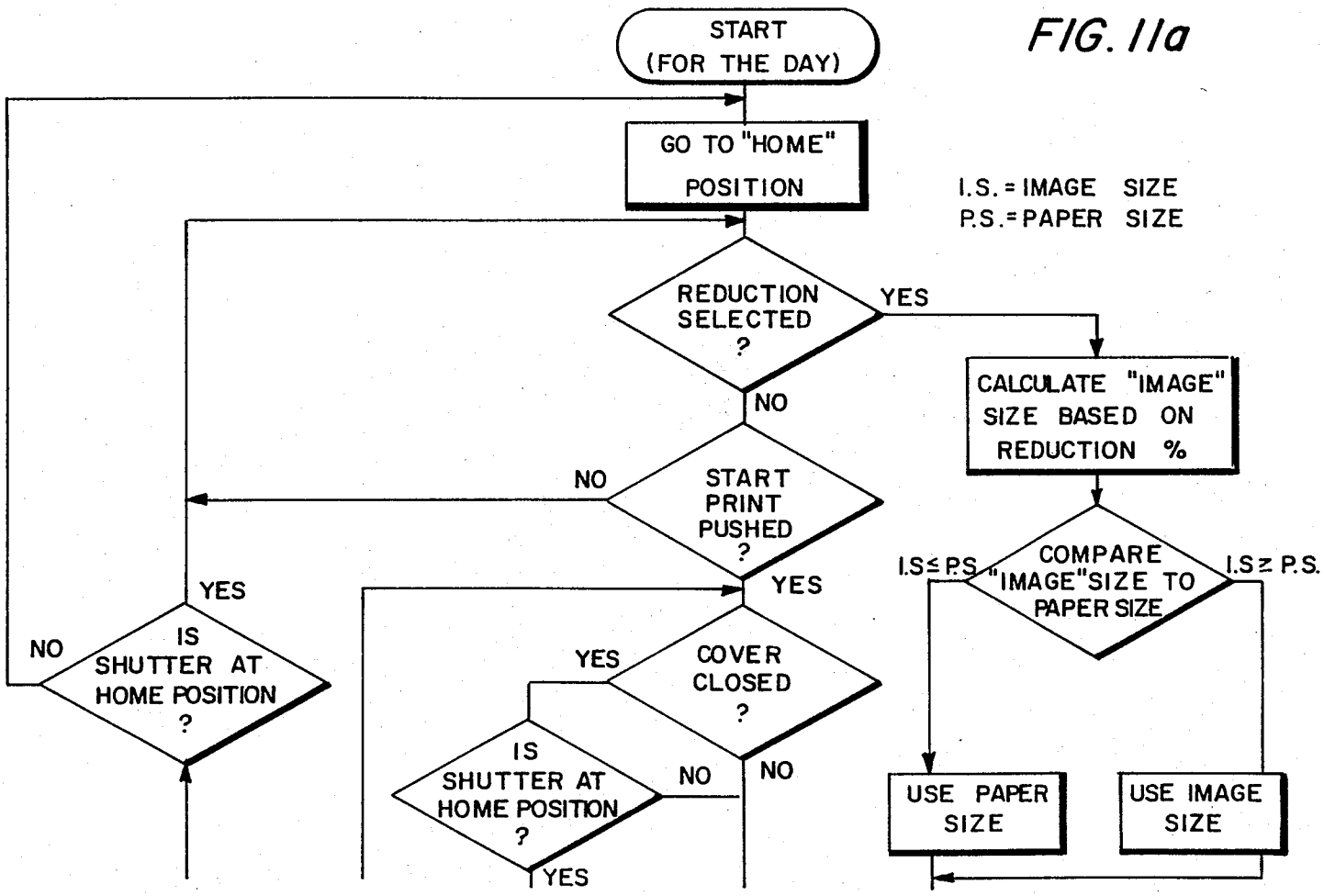
Figure 11B:
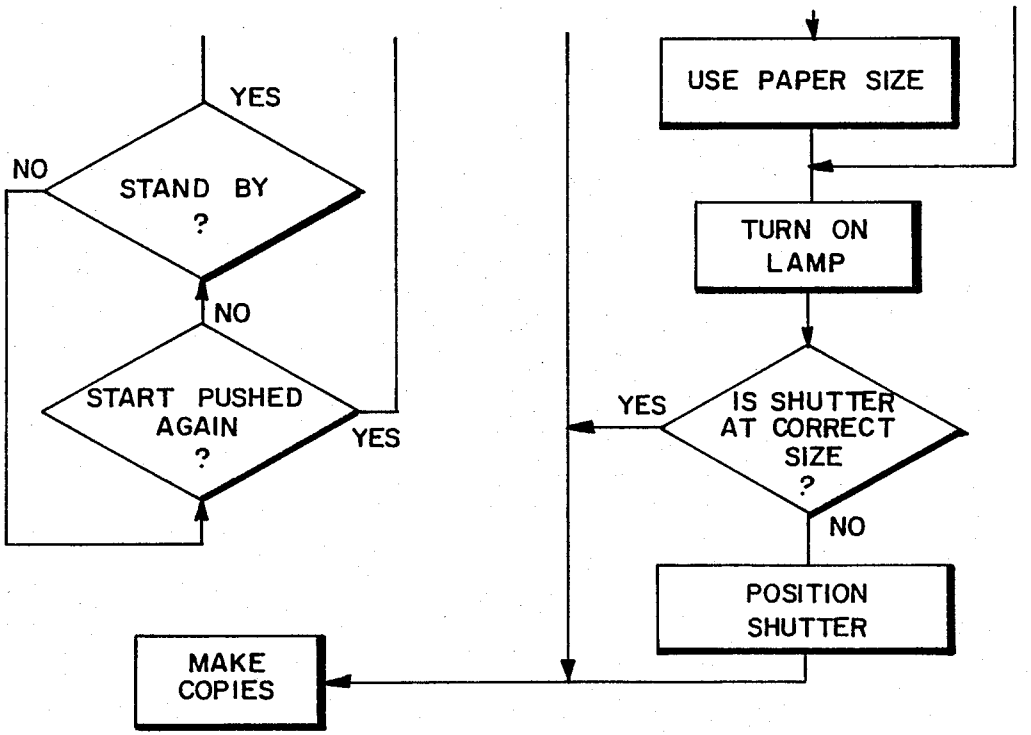

FIGS. 10*a*, 10*b*, and 10*c* are a sequence of views depicting full size and two levels of reduced size latent electrostatic image examples and the relationship thereof to the size of the side areas to be erased; and FIGS. 11*a* and 11*b* are a flow chart depicting the operational sequence for the edge erase control of the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
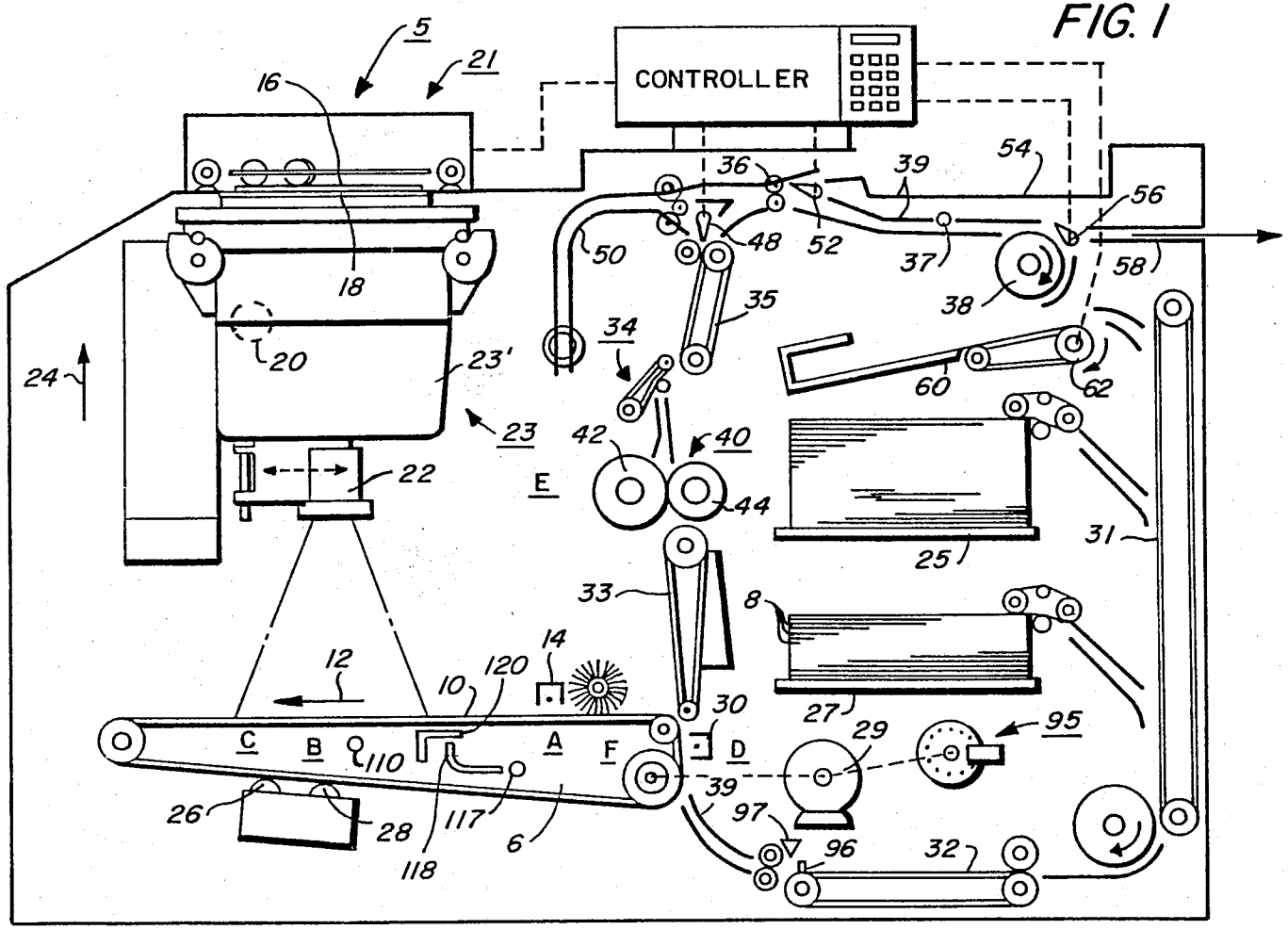
FIG. 1 is a plan view of a reproduction machine incorporating the edge erase control of the present invention.

For a general understanding of the features of the present invention, reference is had to the drawings. In the drawings, like reference numerals have been used throughout to designate identical elements. FIG. 1 schematically depicts the various components of an illustrative electrophotographic printing or reproduction machine 5 incorporating the edge erase control of the present invention therein. It will become evident from the following discussion that the invention is equally well suited for use in a wide variety of printing machines and is not necessarily limited in its application to the particular embodiment shown herein.

Inasmuch as the art of electrophotographic printing is well known, the various processing stations employed in the machine 5 will be shown hereinafter schematically and their operation described briefly with reference thereto.

As shown in FIG. 1, the illustrative reproduction machine 5 employs a belt 10 having a photoconductive surface thereon. Preferably, the photoconductive surface is made from a selenium alloy. Belt 10 is driven by main drive motor 29 and moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit positions original documents 16 facedown over exposure system 23. The exposure system, indicated generally by reference numeral 23 includes an optical cavity 23' of suitable design and configuration with illumination lamp 20 in operative relationship with a transparent platen 18 for supporting the document 16 to be copied. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10.

As will appear, the document handling unit comprises a Semi-Automatic Document Handler (referred to herein as a SADH) 21. SADH 21 feeds the document 16, which may comprise a single sheet or computer form, forward into registered position on platen 18. Following processing, SADH 21 discharges the document into a suitable output receptacle.

While an SADH type of document handling unit is described herein, one skilled in the art will appreciate that other types of document handling units such as a recirculating document handler as well as manual systems may instead be contemplated.

A plurality of sheet transports comprising a vertical transport 31, a registration transport 32, prefuser transport 33, decurler 34, post fuser transport 35, output transport 36, bypass transport 37, and inverter roll 38, cooperate with suitable sheet guides 39 to form a paper through which the copy sheets 8 being processed pass from either main paper supply tray 25, auxiliary paper supply tray 27, or duplex paper supply tray 60 through the machine 5, the finished copies being discharged into top tray 54 or output via discharge path 58 to an output module such as a sorter (SOR). Transports 31, 32, 33, 34, 35, 36, 37, 38 are suitably driven by main drive motor 29. Suitable sheet sensors are provided at the output of each paper tray 25, 27 and duplex tray 60 to detect feeding of a sheet therefrom.

With continued reference to FIG. 1, at development station C, a pair of magnetic brush developer rollers, indicated generally by the reference numerals 26 and 28, bring a suitable developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into transfer relation with the toner powder image. Transfer station D includes a corona generating device 30 which sprays ions onto the backside of the copy sheet. This attracts the toner powder image from the photoconductive surface of belt 10 to the sheet. After transfer, prefuser transport 33 advances the sheet to fusing station E.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, decurler 34 and post fuser transport 35 carry the sheets to inverter gate 48 which functions as an inverter selector. When energized or pulled, gate 48 directs the copy sheets into a sheet inverter 50. When inoperative, gate 48 bypasses sheet inverter 50 and the sheets are fed directly to bypass gate 52. Thus, copy sheets which bypass inverter 50 turn a 90° corner in the paper path before reaching gate 52. Bypass gate 52 directs the sheets into top tray 54 so that the imaged side which has been transferred and fused is faceup. If inverter 50 is selected, the opposite is true, i.e. the last printed face is facedown. Bypass gate 52 normally directs the sheet into top tray 54 or, when energized, to bypass transport 37 which carries the sheet to duplex gate 56. Gate 56 either directs the sheets without inversion to the discharge path 58 or, when energized, to duplex inverter roll 38. Inverter roll 38 inverts and directs the sheets to be duplexed into duplex tray 60. Duplex tray 60 provides intermediate or buffer storage for those sheets which have been printed on one side and on which an image will be subsequently printed on the side opposed thereto, i.e. the copy sheets being duplexed. Due to the sheet inverting action of inverter roll 38, the buffer set of sheets are stacked in duplex tray 60 facedown in the order in which the sheets have been copied.

In order to complete duplex copying, the previously simplexed sheets in tray 60 are fed seriatim by bottom feeder 62 back via vertical transport 31 and registration transport 32 to transfer station D for transfer of the toner powder image to the opposed side of the sheet. Inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to the selected output for subsequent removal by the printing machine operator.

Figure 2:
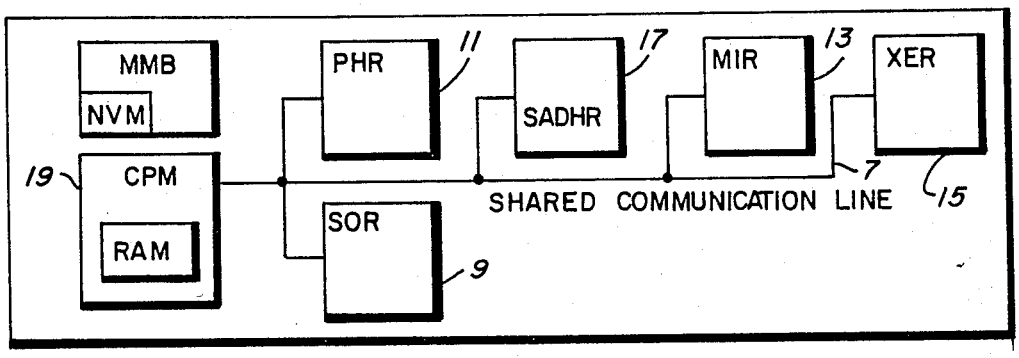
FIG. 2 is a schematic view illustrating the control subdivisions and communication channel for the reproduction machine shown in FIG. 1.

Referring particularly to FIG. 2, reproduction machine 5 is segregated into a series of independent modules (termed remotes herein), and identified as sorter output remote (SOR) 9, paper handling remote (PHR) 11, marking and imaging remote (MIR) 13, xerographic remote (XER) 15, SADH remote 21, and central processing master (CPM) 19. FOR 9, PHR 11, MIR 13, XER 15, SADH 21, and CPM 19 are communicated with one another by means of a shared communication line (SCL) 7 through which controlled instructions and synchronizing clock pulse signals from and to the machine remotes pass.

Figure 3:
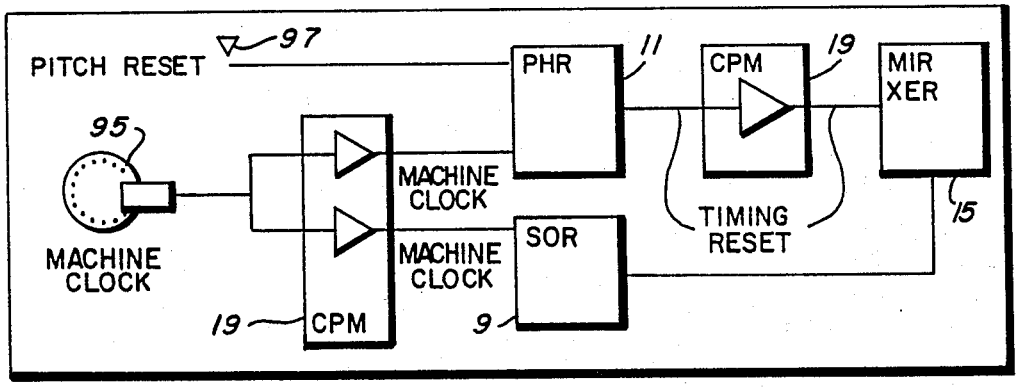
FIG. 3 is a schematic view illustrating the distribution of timing signals to the various control subdivisions for the machine shown in FIG. 1.

Referring particularly to FIGS. 1 and 3, a suitable machine clock pulse generator 95, which is drivingly coupled to the output shaft of main drive motor 29, generates a succession of clock pulses whenever drive motor 29 is energized. As will be understood, to enhance copy throughput, several copy sheets may be in process at various locations along the paper path at any one time. To accommodate this and permit individual copies to be tracked and processed in the particular manner desired, timing control over the copy processing functions is divided into pitches, each pitch being further subdivided into a number of machine clock pulses. For example, the paper path may be separated into eleven pitches with each pit being composed of approximately 850 machine clock pulses.

Pitch reset signals, which serve in effect to determine the length of the pitch and the number of machine clock pulses within the pitch, are derived from copy sheet registration finger 96. For this purpose, a sensor such as switch 97 is disposed in the path of movement of copy sheet registration fingers 96 such that on each cycle of finger 96 past switch 97, switch 97 outputs a reset signal. The output of machine clock pulses by generator 95 are input through CPM 19 to PHR 11 while the pitch reset signals generated by switch 97 are input directly to PHR 11.

Figure 4:
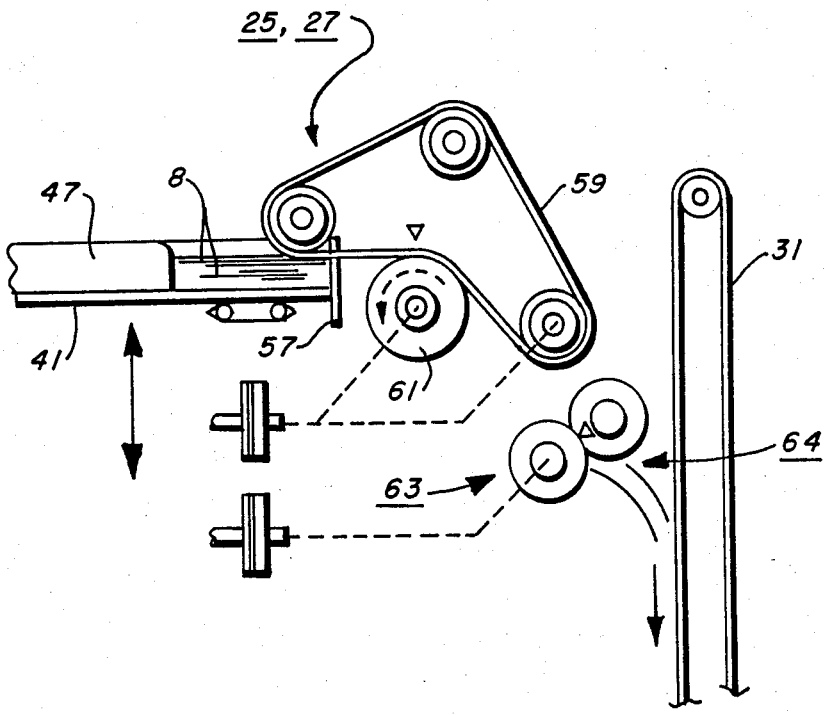
FIG. 4 is a fragmentary elevational view showing details of the machine main and auxiliary paper trays.
Figure 5:
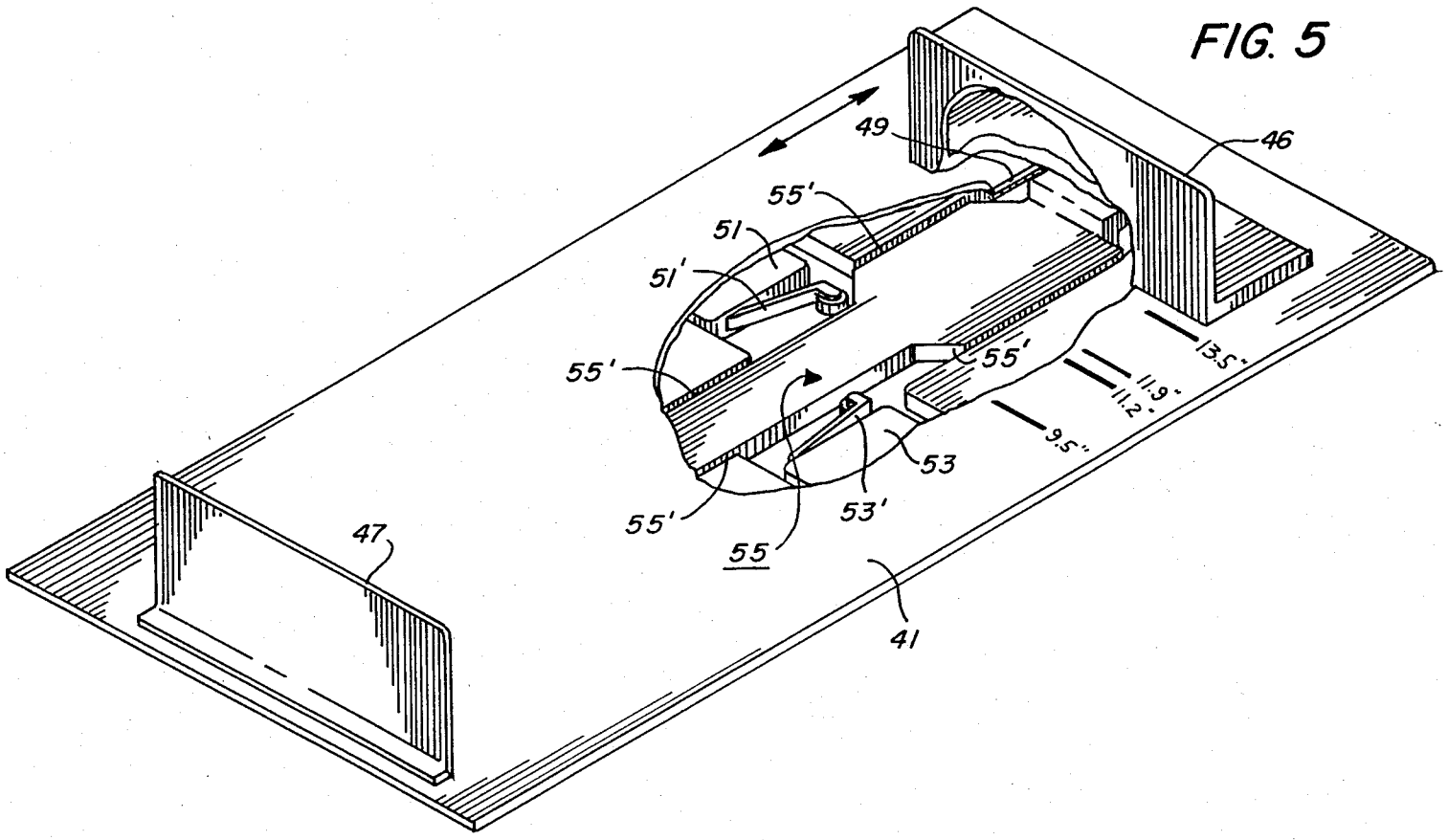
FIG. 5 is an isometric view showing details of the adjustable side guides for the paper trays shown in FIG. 4.

Referring to FIGS. 4 and 5 of the drawings, main and auxiliary paper trays 25, 27 each include a movable sheet elevator or base 41 onto which a stack-like supply of copy sheets 8 may be placed for use by the reproduction machine 5. A pair of sheet guides 46, 47 are provided for locating and retaining the copy sheets 8 in predetermined feeding position normal to the direction of sheet feed. A sheet stop 57 locates the copy sheets in the sheet feeding direction.

The sheet guide 46 of both main and auxiliary trays 25, 27 is slideably supported within a slot-like opening 49 in base 41 to permit manual adjustment of guide 46 in accommodation of the size copy sheets 8 being processed. Sheet guide 46 is coupled through slot 49 with an elongated base member 55, the sides 55' which have predetermined relief or cutout portions which function to delineate the particular copy sheet size setting of the sheet guide 46. A pair of sensors 51, 53 are provided on either side of base member 55, arms 51', 53' of sensors 51, 53 riding against the sides 55' thereof. In the example shown, four copy sheet size settings are contemplated, one a copy sheet size of 9.5" to 11.2" in which sensors 51, 53 are closed and open respectively, a second a sheet size of 11.2" to 11.9" in which both sensors 51, 53 are closed, a third a sheet size of 11.9" to 13.5" in which sensors 51, 53 are opened and closed respectively, and a fourth a sheet size in excess of 13.5" in which both sensors 51, 53 are open.

A sheet feeder in the form of an endless belt 59 cooperates with a retard roll 61 to advance one sheet at a time forward to a take-away roll pair 63 at a wait station 64 during operation of machine 5. On demand for a copy sheet, roll pair 63 is actuated to feed the sheet from wait station 64 onto vertical transport 31.

Figure 6:
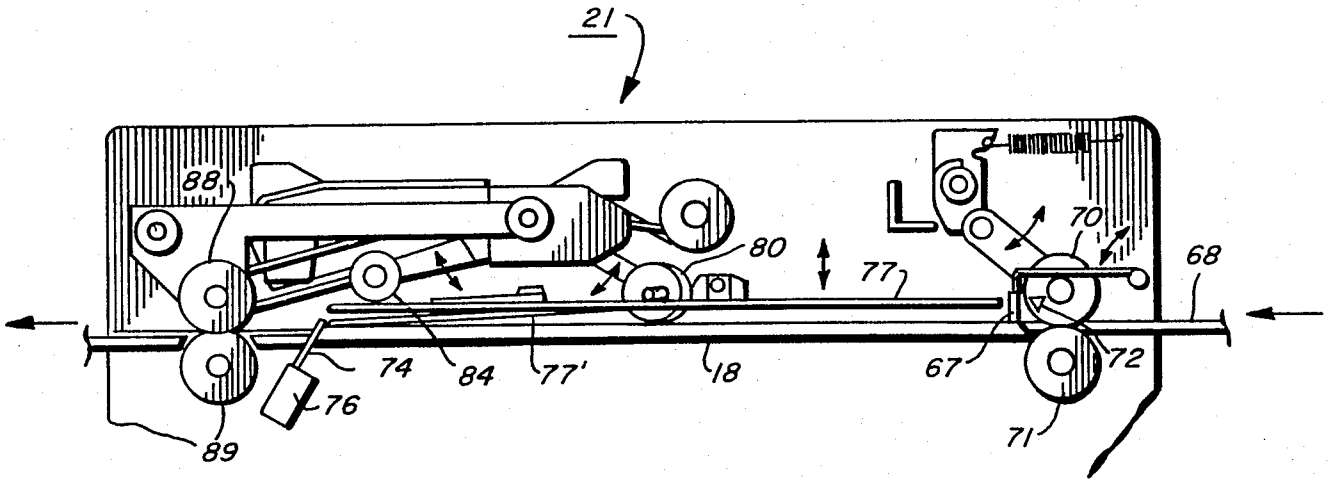
FIG. 6 is a side view in cross section showing a platen cover in the form of a document handler, with the document handler components disposed for feeding a document or computer forms page onto the machine platen.
Figure 7:
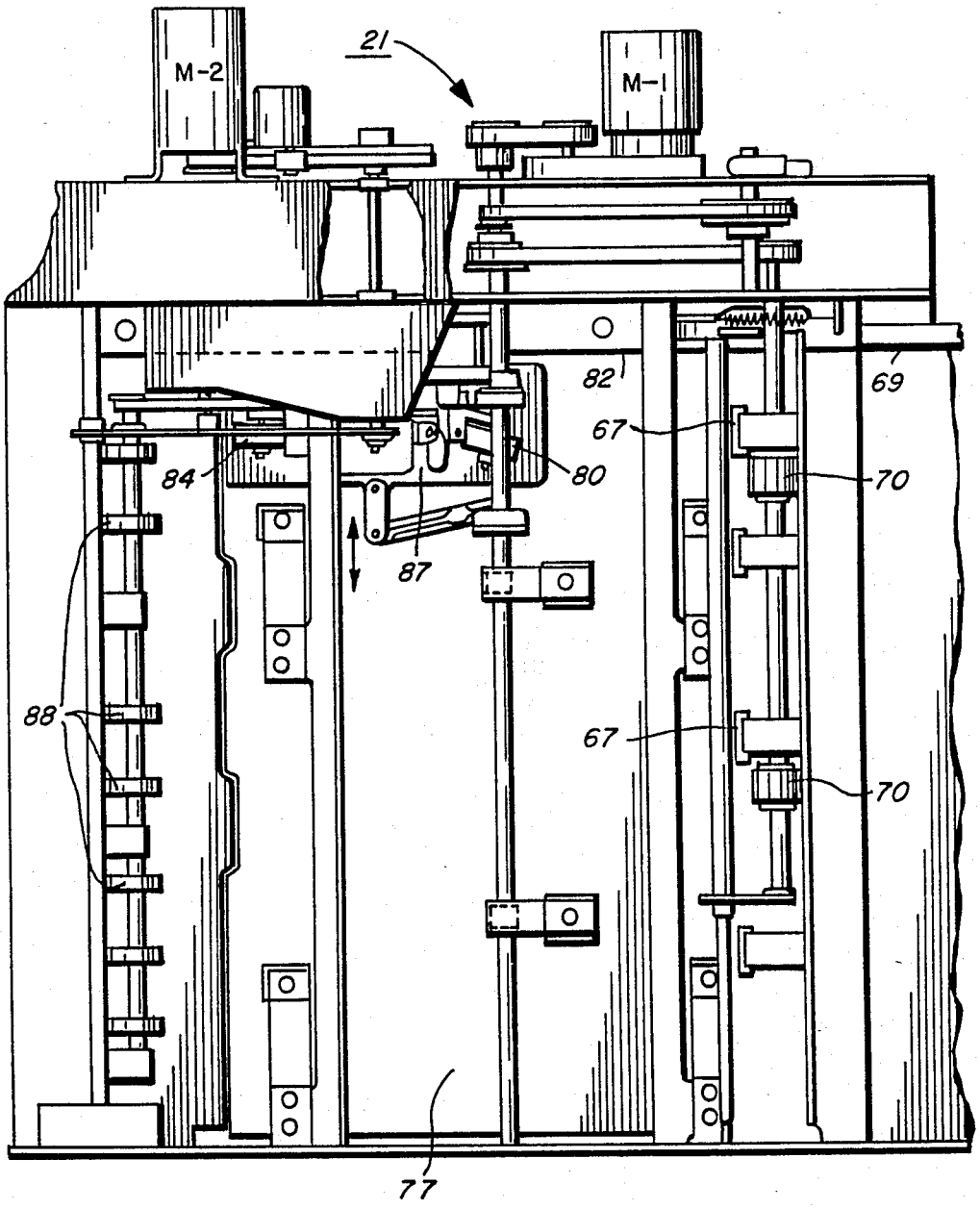
FIG. 7 is a top plan view of the document handler shown in FIG. 6 with the document handler shutter closed.
Figure 8:
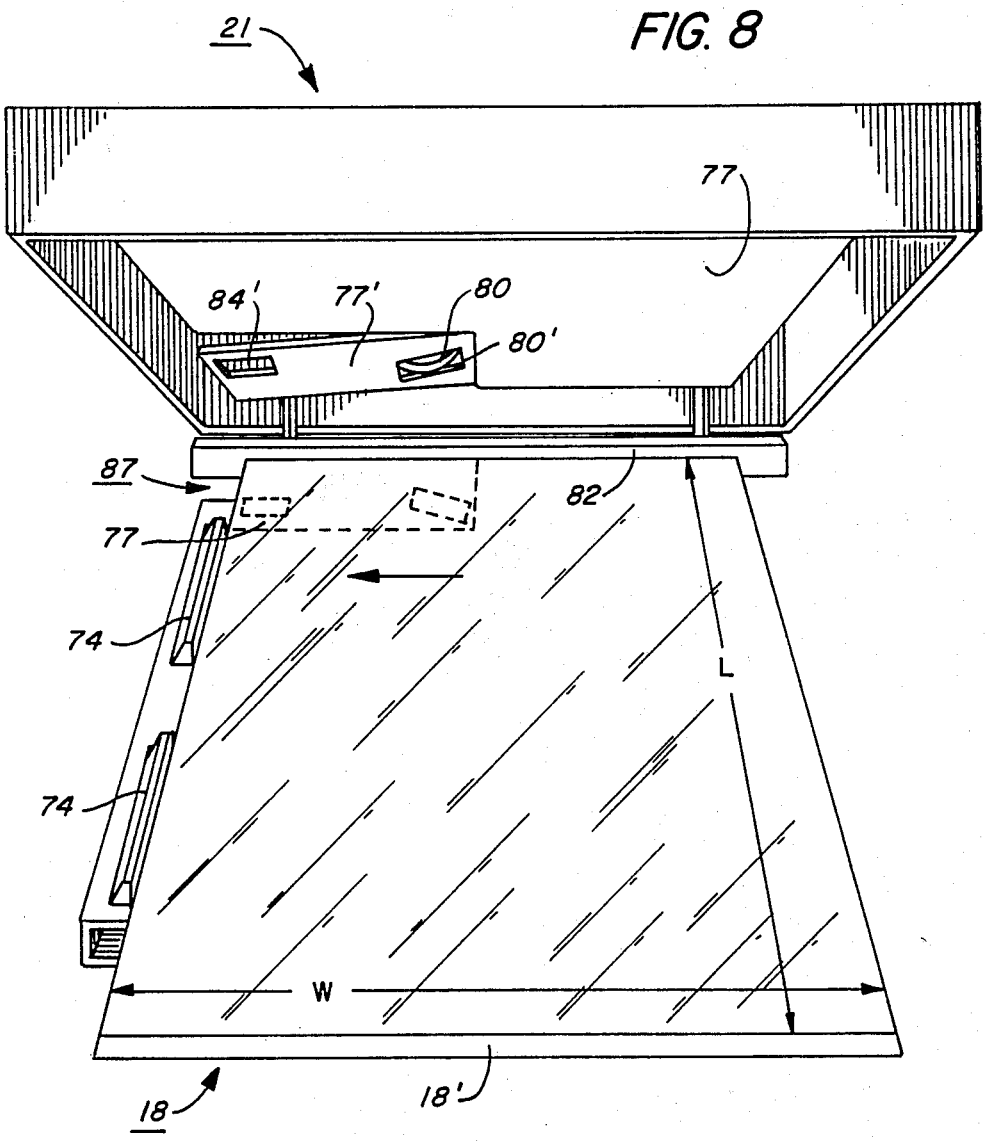
FIG. 8 is an isometric view showing the document handler type platen cover of FIG. 6 in a raised or open position.

Referring now to FIGS. 6–8, SADH 21 operates, in a first or semi-automatic document handling mode to feed one document at a time placed in input tray 68 by the user or operator automatically onto the platen 18 in registered position for copying. Following copying, SADH 21 removes the document from platen 18 and deposits the document in a suitable output tray provided for this purpose. In a second computer forms feeding copying mode, SADH 21 operates to feed documents in the form of an endless web into registered position on platen 18 for copying page by page. In this mode, a suitable collector for computer form web (not shown) is provided.

SADH 21 is hinged for opening and closing movement on reproduction machine 5 at the back of machine 5, SADH 21 on opening thereof pivoting about an axis substantially parallel to the direction of document/computer form movement. This permits SADH 21 to be manually raised to an out of the way position as shown in FIG. 6 to expose platen 18 permitting the user or operator to manually place a document to be copied on platen 18 when operating in a third, manual copying mode.

Pre-registration fingers 67 are provided for registering the leading edge of the document or computer form in proper position at the inlet to SADH 21. Side registration guides 69 position the document or computer form laterally. Feed rollers 70, which are drivingly coupled to a suitable motor M1, cooperate with pinch rollers 71 to advance the document or computer form forward onto platen 18. A suitable document sensor 72 is provided adjacent pre-registration fingers 67 to detect the presence of the document or computer form leading edge and enable operation of SADH 21. Pre-registration fingers 67 and feed rollers 70 are supported for pivotal movement such that on detection of the document leading edge by sensor 72, rollers 70 (which are normally raised) are moved downwardly to form a nip with idler rolls 71, while pre-registration fingers 67 (which are normally lowered) are raised up to permit the document or computer form to be carried forward onto platen 18. Suitable cam means may be provided for this purpose as will be understood by those skilled in the art.

A platen clamp 77, which is mounted for limited raising and lowering movement on the underside of SADH 21 and which overlays platen 18 on closure of SADH 21 is provided. Clamp 77, when lowered serves to press the document or computer forms page on platen 18 against the platen surface. Clamp 77 is generally rectangular in shape with length and width dimensions equal to or slightly greater than the length (L) and width (W) of platen 18. As a result, clamp 77 overlays or covers the entire platen 18 when SADH 21 is lowered into operative contact therewith.

Clamp 77 is selectively raised and lowered by suitable means such as cams. Clamp 77 is raised when feeding a document or computer form forward onto or off of platen 18 (the position shown in FIG. 1) and lowered into light pressing engagement with the document or computer forms page on platen 18 during exposure.

To fed the document or computer form into imaging position on platen 18, an on-platen scuffer roller 80, drivingly coupled to a suitable servo motor M2 and mounted above clamp 77, is provided. Preferably roller 80 is positioned such that roller 80 is at a slight angle to the direction of feed. As a result, roller 80 both advances the document or computer form forward and sideways, the latter motion serving to bring the side edge of the document or computer form in engagement with a lateral registration edge 82. It is understood that where the width dimension of the document is equal to or less than the width (W) of platen 18 (which is the normal case), the document trailing edge exits feed rollers 70, 71 and accordingly comes under the sole control of scuffer roller 80. Where a computer forms web is being fed, the web normally remains in the nip of rollers 70, 71. To accommodate this, rollers 70, 71 are rotated for a predetermined time interval to assure, in cooperation with scuffer roller 80, proper positioning of the computer forms page on platen 18.

To align or register the document or computer form in proper position on platen 18, retractable registration fingers 74 are provided at the downstream edge of platen 18. Registration fingers 74 are selectively raised or lowered by a solenoid 76, fingers 74 being raised to intercept and register a document or the leading edge of a computer form being fed onto platen 18 and lowered to permit the document to be cleared from platen 18 and advancing and processing of successive pages of the computer form.

A kickoff or ejecting roller 84 is mounted above clamp 77 downstream of scuffer roller 80. To facilitate the feeding action of scuffer roller 80 and ejecting roller 84, the section 77′ of clamp 77 (seen best in FIG. 8) housing rollers 80, 84 is independently mounted for limited pivotal movement. As a result, clamp section 77′ depends downwardly into proximity with the surface of platen 18 opposite thereto when platen clamp 77 is raised during feeding of a document or computer forms page onto or off of platen 18. Both scuffer roller 80 and ejecting roller 84 are supported for controlled raising or lowering within associated apertures 80′ 84′ in clamp section 77′. Scuffer roller 80 and ejecting roller 84 are raised and lowered in a controlled manner by suitable means such as cams, roller 84 being raised to permit the document or computer form to pass unimpeded when registering a document or computer form page on platen 18 while roller 80 is raised and roller 84 lowered when clearing the document page or advancing the computer form forward to the next page. To close off apertures 80′, 84′ in clamp section 77′ during exposure when scuffer roller 80 and ejecting roller 84 are retracted, a movable shutter 87 is provided above clamp section 77′ for interposition between the retracted rollers 80, 84 and the interior of clamp section 77′ across apertures 80′, 84′. Shutter 87 is driven by a suitable cam operated linkage mechanism. To control and erase non-image areas, the bottom faces of clamp 77 and shutter 87 are covered by or made from a suitable light reflecting material such as white.

When copying in either the first or second modes, the document or the leading edge of a computer form is abutted by the operator or user against pre-registration fingers 67 (fingers 67 are in a down position for this purpose) and lateral registration edge 69 with the document or computer form resting on input tray 68.

On sensing the presence of the document or computer forms leading edge, a signal from sensor 72 to the machine CPM 19 lowers input roller 70 while raising pre-registration fingers 67. Feed rollers 70, 71, which are driven by motor M-1, cooperate to advance the document or the first computer forms page forward onto platen 18 in cooperation with scuffer roller 80, which is lowered at this point. Scuffer roller 80 is driven by motor M-2. The document or computer forms web is advanced across platen 18 by rollers 70, 71 and 80 until the leading edge thereof abuts against registration fingers 74 which are raised for this purpose. Concurrently, the sideways motion imparted by scuffer roller 80 registers the side edge of the document or computer forms web against lateral registration edge 82. With registration completed, scuffer roller 80 and feed rollers 70 are raised while platen clamp 77 is lowered, the latter in cooperation with clamp section 77′ pressing the document or computer form page flat against platen 18. Shutter 87 is also actuated to close off or shut apertures 80′, 84′ in clamp section 77′. The document or computer form page on platen 18 may then be exposed by reproduction machine 5.

Following completion of the machine exposure cycle, clamp 77 is raised while shutter 87 is moved to a position where apertures 80′ 84′ for scuffer roller 80 and ejecting roller 84 are opened. Ejecting roller 84 is lowered into engagement with the document on platen 18 while registration gate solenoid 76 is actuated to drop registration fingers 74 and clear the exit path from platen 18. Ejecting roller 84 is driven at high speed by motor M2 to eject the document from platen 18.

Where computer form is being processed, actuation of shutter 87 is inhibited while solenoid 76 is held actuated to retain registration fingers 74 retracted for processing of subsequent pages of the endless computer form.

As the document or computer forms page is fed off on platen 18, the document or computer form is carried by take-away roller pair 88, 89, disposed adjacent to and on the downstream side of platen 18 and driven by motor M2, to the document output tray (when operating in the first mode) or to a suitable receptacle for collecting computer form (when operating in the second mode).

While a SADH type of document handler has been illustrated herein, other document handler types and constructions such as Recirculating Document Handlers (RDH) may be envisioned as well as non-feeding manual platen covers. In all applications, however, the underside portions of the document handler or cover overlaying the platen are sized to cover the entire platen on closure thereof, the cover underside having a reflective surface for reflecting light and discharging the non-imaged areas of the photoreceptor belt 10 as will appear more fully herein.

Referring now to FIGS. 10*a*, 10*b*, 10*c*, it will be understood that where for example multiple copies of a document or computer forms page are being made, a series of spaced latent electrostatic images 100 are created through exposure of the document or computer forms page on platen 18 to the moving photoreceptor belt 10. In the exemplary arrangement described heretofore, SADH 21 registers the document or computer forms page in one corner of platen 18.

Where SADH 21 is not used, the operator or user is instructed to register the document or computer forms page against registration fingers 74 and lateral registration edge 82 in the corner of platen 18. As a result, one edge (identified herein for convenience as top edge 104) of the latent electrostatic image 100, whatever the image size, is fixed in position on photoreceptor belt 10. An undischarged non-image area, referred to as photoreceptor side edge 102 herein, exists between image edge 104 and the edge of belt 10 as well as a second undischarged non-image area, referred to as photoreceptor side edge 103 herein, between the bottom edge 105 of the maximum size image 100 and the opposite edge of belt 10. Further, where the document or computer forms page being copied is smaller in width than platen 18, an additional non-image area 103' occurs between the photoreceptor side edge 103 and the bottom edge 105 of the latent image 100 as shown by FIGS. 10*b* and 10*c*. It is understood that since the document or computer forms page has one side registered against registration edge 82, a non-image area corresponding to non-image area 103' does not normally occur between side edge 102 and top edge 104 of the latent image 100.

Additionally, there are undischarged non image areas before the first image, between successive images, and after the last image. For explanation purposes, these areas are collectively referred to and identified herein as interdocument areas 106. As will appear, side edges 102, 103 and any non-image area 103' are discharged to prevent unwanted development thereof as are the interdocument areas 106.

On a reduction in image size, the non-image area 103' between the bottom edge 105 of the image and the photoreceptor side edge 103 as well as the interdocument area 106 increases in size. This is because, as demonstrated in FIGS. 10*a*, 10*b*, 10*c*, changes in the size of the image displaces the position of bottom edge 105 and the image sides 107. This in turn changes the physical size of the non-image area 103' and the interdocument area 106 which must be discharged, i.e. erased, if development of these non-image areas is to be avoided.

As described, platen 18 and lens 22 are mounted for movement in the direction shown by the solid line arrows of FIG. 1 to effect a change in size of the image 100. In the exemplary arrangement shown, movement of lens 22 as described effects a reduction in image size. Concurrently therewith, lens 22 is moved in a plane at right angles thereto as shown by the dotted line arrows in FIG. 1 to maintain the top edge 104 of the reduced image created (identified herein by numeral 100') fixed in position on belt 10.

Figure 9:
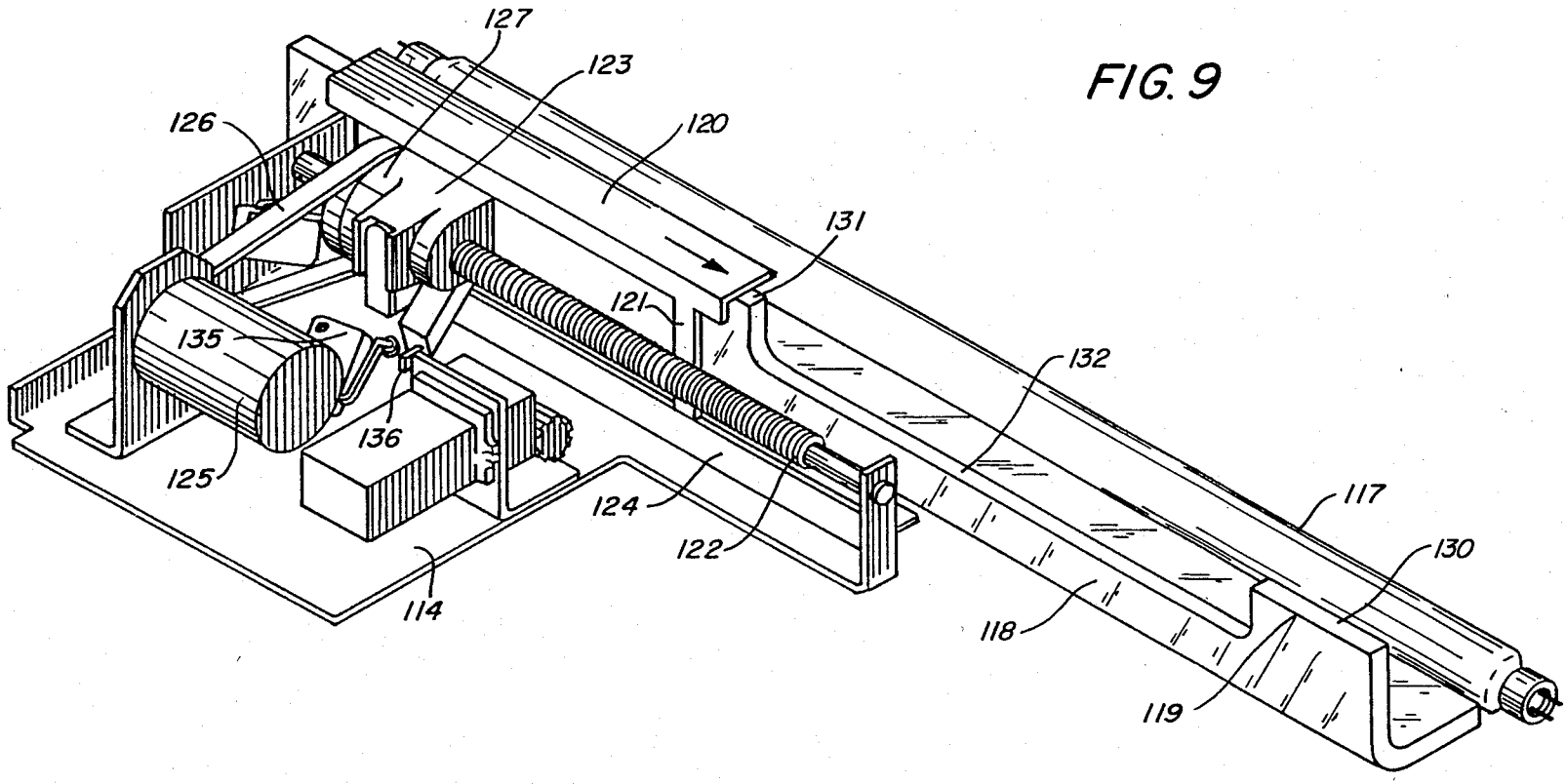
FIG. 9 is an isometric view showing details of the machine edge fadeout lamp and control shutter.

Referring to FIGS. 1 and 9, to erase or discharge the interdocument area 106, the photoreceptor side edges 102, 103, and in certain cases the non-image area 103', interdocument and edge erase lamps 110, 117 are provided in the interior of the photoreceptor module 6. Interdocument erase lamp 110, the axial length of which is at least equal to the width of belt 10, is mounted at right angles to the direction of movement of belt 10 facing the inside surface of belt 10. As will be understood by those skilled in the xerographic arts, operation of interdocument erase lamp 110 is synchronized with movement of belt 10, lamp 110 being energized during periods when no image is present on belt 10 and being deenergized when an image is present.

Edge erase lamp 117 is suitably supported within photoreceptor module 6 with the axis of lamp 117 at right angles to the direction of movement of belt 10. The axial length of edge erase lamp 117 is at least equal to the width of belt 10. A plate-like light pipe 118 having a generally U shape is optically coupled between edge erase lamp 117 and the interior surface of photoreceptor belt 10. The light discharge edge 119 of light pipe 118 facing belt 10 is defined by top and bottom edge erase segments 130, 131 and central non-erase segment 132. Top edge erase segment 130 of light pipe 118 has an axial length equal to the width of the photoreceptor side edge 102 which due to the fixed registration point of image top edge 104, remains substantially constant whatever the size image being reproduced. Bottom edge erase segment 131 of light pipe 117 has an axial length equal to the sum of the photoreceptor side edge 103 plus the width of the largest size non-image area 103' to be erased.

To enable the effective size of the bottom edge erase segment 131 of light pipe 117 to be adjusted in accordance with the size of the non-image area 103' (it is understood that the size of the non-image area 103 changes with changes in the size of the image 100), an adjustable shutter 120 is interposed between the light discharge side 119 of light pipe 118 and belt 10. Shutter 120 is supported by a shutter housing 114 positioned within the belt module 6. For this purpose, an elongated drive screw 122 is rotatably mounted in housing 114 alongside shutter 120. Screw 122 is coupled to shutter 120 through coupling member 123. A depending arm 121 on shutter 120 rides in a U-shaped track 124 on housing 114 to guide shutter 120 back and forth upon rotation of drive screw 122. A suitable driving motor such as servo motor 125, is provided to drive shutter 120, the output shaft of motor 125 being coupled to screw 122 through transfer belt 126 and gear 127. A shutter locating switch 135 cooperates with projection 136 on member 123 to define the home or park position of shutter 120. In the arrangement shown, the shutter park position comprises the maximum closure position of shutter 120 relative to erase segment 131. This normally corresponds to the width of the photoreceptor side edge 103 as depicted in FIG. 10*a*.

In order to avoid degradation of photoreceptor belt 10 through over-exposure of the non-image area 103' to light from edge erase lamp 117, light from the reflective surfaces of platen clamp 77 and shutter 87 of SADH 21 is instead used during exposure of the document or computer forms page on platen 18 to discharge area 103'. However, as can be understood, reflected light is not available when SADH 21 is in the raised position shown in FIG. 8, or when the size of the image 100 is reduced.

Further, during reduction, and as illustrated by the example shown in FIGS. 10*b*, 10*c*, non-reflecting or light absorbing structures within the optical cavity 23' may be unavoidably brought into the field of view. This can result from the multiple axis movement of lens 22, i.e. along a first axis away from platen 18 (shown by the solid line arrow in FIG. 1) and along a second axis paralleling platen 18 (as shown by the dotted line arrow in FIG. 1). Such multi-axis movement of lens 22 both changes and shifts the field of view of lens 22 so that peripheral parts of the illumination cavity may be brought into the field of view. In the example shown, the platen side edge 18', (see in FIG. 8) which is non-reflective, shows up as a faint black line 140 during reduction, the position of line 140 changing from a point outside the image area (an example of which is identified as point a in FIG. 10*b*) to a point just inside the image area (identified as point b in FIG. 10*c*).

Where line 140, for the reduction mode selected, appears outside the image area, i.e. in the non-image area 103' as depicted in FIG. 10*b*, line 140 is, as will appear, erased automatically with the discharge of non-image area 103' through the cooperation of edge erase lamp 117 and shutter 120. Where line 140 intrudes into the image area as depicted in FIG. 10*c*, shutter 120 is automatically adjusted to permit erasure not only the non-image area 103' but also the portion of the image 100' adjoining bottom edge 105 up to and including line 140. As will be understood, the minimal amount of image area being erased corresponds to the normally blank document boundary and hence the image content of the copy produced by reproduction machine 5 is not affected.

OPERATION

Operation of reproduction machine 5 to produce copies from documents or computer form pages on platen 18 is in the conventional xerographic manner understood by those skilled in the art. In that context, the document or computer forms page on platen 18 is illuminated by lamp 20, the resulting image rays being transmitted by lens 22 to photoreceptor belt 10 at exposure station B. There the belt 10, which was previously uniformly charged at charge station A by corotron 14, is exposed to create a latent electrostatic image of the document or computer forms page on belt 10. The latent electrostatic image is carried first by belt 10 to developing station C where the image is developed by developer rolls 26, 28 and thereafter to transfer station D where the developed image is transferred to a copy sheet supplied from either main or auxiliary paper trays 25, 27 and brought forward on sheet transports 31, 32.

Following transfer, the copy sheet is carried by transport 33 to fuser 40 where the developed image is fixed and thereafter by decurler 43 and transport 35 to output tray 54, or selectively, by transport 37 and inverter roll 38 to discharge path 58. Optionally, inverter 50 may be actuated by setting inverter gate 48. Duplex copies are made by setting duplex gate 56 to route the copy into duplex tray 60 from which the copy is re-fed through the xerographic processing system to provide a second or duplex image on the reverse side of the copy sheet.

Referring particularly to FIGS. 9, 11*a*, and 11*b* of the drawings and Table I, where reproduction machine 5 is first turned on, normally at the start of the day, a check is made to determine if edge fadeout shutter 120 is in the parked (i.e. HOME) position as defined by home switch 135. If the signal from switch 135 indicates shutter 120 to be in the home position, no further action is taken. Where however the signal from switch 135 indicates shutter 120 is not in the home position, drive motor 125 is energized to drive shutter 120 to the home position as identified by switch 135. It is understood that this may result in movement of shutter 120 in a direction opposite to that of switch 135 (i.e. away from the home position) followed by reverse movement of shutter 120 to the home position, since motor 125 operates drive screw 128 in one direction only. When shutter 120 is in the home position, motor 125 is deenergized.

With shutter 120 in the home position (the position shown in FIG. 9), bottom edge erase segment 131 is sized to discharge the minimum non-image area (i.e. photoreceptor side edge 103) corresponding to the maximum size image 100 (as illustrated by the example of FIG. 10*a*) with energization of edge fade out lamp 117. Top edge erase segment 130, which is of predetermined fixed extent, is unaffected by the disposition of shutter 120. Accordingly, on operation of reproduction machine 5, bands of light from edge fade out lamp 117 equal to the width dimension of photoreceptor side edges 102, 103 strike belt 10 and discharge or erase the photoreceptor side edges on energization of lamp 117.

Where SADH 21 is used, SADH 21 is placed in the down postion over platen 18 (shown in FIG. 6) and the leading edge of the document (semi-automatic document mode) or computer form (computer forms mode) to be copied manually inserted against pre-registration fingers 67 as described. With SADH 21 in position over platen 18, and no reduction selected, erasure of any non-image area 103' is effected through reflection of light from the reflective lower surface of SADH 21 which in the exemplary structure described comprises platen clamp 77 and shutter 87, it being understood that shutter 87 is in position covering apertures 80', 84' in clamp segment 77' during exposure.

On detection of the document or computer forms leading edge by sensor 72, the document or first page of the computer form is carried forward into registered position against registration fingers 74 and lateral registration edge 82 as described. With the document or computer forms page in registered position on platen 18, scuffer roller 80 is raised, platen clamp 77 lowered, and shutter 87 moved to a position overlaying or covering apertures 80', 84' for scuffer and ejecting rollers 80, 84 respectively in clamp segment 77'. As a result, a continuous highly reflective surface composed of clamp 77, clamp segment 77', and the portions of shutter 87 opposite apertures 80', 84' overlaying platen 18 is provided.

Where no change in image size, i.e. reduction, is selected by the operator or user, on actuation of reproduction machine 5 to make copies (START PRINT PUSHED?), a check is made to determine if the platen cover, in this case SADH 21, is closed (COVER CLOSED?). With shutter 120 parked and SADH 21 closed, machine 5 operates to make the copy or copies programmed. Edge erase lamp 117 is energized to erase the photoreceptor side edges 102, 103 while the reflective surface presented by clamp 77, clamp segment 77', and shutter 87 of SADH 21 is relied on to discharge any non-image area 103' laying between the photoreceptor side edges 102, 103 and the top and bottom edges 104, 105 of the latent image 100. Since the document or computer forms page is placed in predetermined registered position on platen 18 with one side against lateral registration edge 82, any non-image area 103 will occur in the space between photoreceptor side edge 103 and edge 105 of image 100.

Should reproduction machine 5 go into standby during the copy run, actuation of the start/print button (START/PRINT PUSHED AGAIN?) causes a recheck to be made to determine if SADH 21 is still closed (COVER CLOSED?). If so, reproduction machine 5 is operated to make copies.

In the event the platen cover, i.e. SADH 21, is opened as shown in FIG. 8, edge fade out lamp 117 is relied upon to discharge both the photoreceptor side edges 102,103 and any non-image area 103'. In that event the size of the copy sheet being fed from the paper tray in use, i.e. main or auxiliary tray 25, 27 respectively, is determined from the signal output of paper size sensors 51, 53 in accordance with the setting of the paper guide 46 for the tray in use (Tables II–VI). If the copy sheet size is the same as the size for which edge face out shutter 120 is then set (IS SHUTTER AT CORRECT SIZE?), no change in shutter position is required. Reproduction machine 5 is accordingly enabled (MAKE COPIES).

In the exemplary arrangement described, shutter 120 is normally positioned in the home position. As a result, bottom edge erase segment 131 is set to discharge the photoreceptor side edge 103 on energization of edge fade out lamp 117. As described, the top edge erase segment 130 for erasing non-image area 102 is preset to the size of side edge 102 which, due to the fixed registration point for the document or computer forms page on platen 18, is constant.

Where the paper size is determined to require re-positioning of shutter 120, shutter 120 is moved by controlled energization of shutter drive motor 125. For this purpose, the desired position of the shutter 120 is calculated (DETERMINE DESIRED POSITION; Table IV), the shutter movement required being expressed in terms of clock counts (Required Pulses). Shutter 120 is then postioned (POSITION SHUTTER; Table V) by energizing motor 125(MOVE SHUTTER; Table VI) until the required number of pulses (Required Pulses) are obtained. It will be understood that the number of clock pulses required (Required Pulses) is equal to the number of clock counts representing the present position of shutter 120 (Shutter Position) plus the number of pulses required to bring the shutter from the existing shutter position to the desired position (Received Pulses). On shutter 120 reaching the desired position, operation of shutter drive motor 125 is terminated and reproduction machine 5 enabled (MAKE COPIES).

Where the operator or user changes image size, i.e. selects reduction, the image size (I.S.) is calculated (CALCULATE IMAGE SIZE) based on the reduction selected (Table IV). A comparison is made between the calculated image size (I.S.) and the paper size (P.S.), i.e. the size of the copy sheet in use, the latter being determined from the setting of the tray guide 46 in the paper tray in use as described heretofore. Where the image size (I.S.) is greater than the paper size (P.S.), i.e. (I.S.>P.S.), shutter 120 is positioned in accordance with the size paper in use. In this situation, line 140, because the image is larger than the copy paper, appears outside the copy paper edge and in the non-image area 103'. Line 140 accordingly will be erased along with the photoreceptor side edge 103 and the non-image area 103' by edge erase lamp 117.

Where the image size (I.S.) is equal to or less than the paper size (P.S.), i.e. I.S.≦P.S.), shutter 120 is positioned in accordance with the image size to assure erasure of line 140 as well as the non-image area 103' by edge erase lamp 117.

While the invention has been described with reference to the structure disclosed, it is not confined to the details set forth, but is intended to cover such modifications or changes as may come within the scope of the following claims.

TABLE I

EDGE FADEOUT SHUTTER CONTROL - POSITION_SHUTTER

```
PAGE
LOCAL PROCEDURE SEEK_HOME;
/*

DESCRIPTION:          THIS PROCEDURE CAUSES THE SHUTTER TO GO TO
                      THE HOME POSITION (AS DEFINED BY THE HOME SWITCH)

ENTER;
   START FAULT_MANAGER (EFSHOMEFLT,1,FAULTCLEAR);
   START STATE_HANDLER (GOBUSY\EDGESHUTTERSTATE);
   SEARCH BEGIN; /* SEARCH FOR THE HOME SWITCH */
      CLOCK@TICS <- 0;
      IF EDGE#HOM!=HOMED THEN EDGE$MOT <- ON;
      KEEP LOOPING;
         RACE;
            CASE EDGE#HOM = HOMED;
               EDGE$MOT <- OFF;
               HOME@LOST <- FALSE;
               ADVANCE BEGIN; /* ADVANCE TO THE HOME POSITION */
                  REQUIRED@PULSES <- EFS@HOME;
                  MOVE_SHUTTER;
                  IF EDGE#HOM=HOMED THEN EXIT KEEP; /* HOME SW STILL MADE IMPLIES AN ERROR */
                  SHUTTER@POSITION <- HOME_POSITION;
               END;
               EXIT SEARCH;
            CASE 100 MS;
               IF INTERLOCKS_CLOSED THEN CLOCK@TICS <- CLOCK@TICS + 1;
         END;
      RELOOP UNTIL CLOCK@TICS>TIMELIMIT; /* NORMAL EXIT IMPLIES AN ERROR */
      EDGE$MOT <- OFF;
      START DECLARE_FAULT (EFSHOMEFLT);
      START INCREMENT_COUNTER (EFS@FAULT@CNT);
      HOME@LOST <- TRUE;
      SEQUENTIAL@FAULTS <- SEQUENTIAL@FAULTS + 1;
   END;
   RETURN;
```

TABLE I (Pg. 2)

EDGE FADEOUT SHUTTER CONTROL - POSITION_SHUTTER

```
        END;
     RELOOP;
     SEQUENTIAL@FAULTS <- 0; /* POSITION OK .. CLEAR FAULT COUNTER */
   END;
   EDGE$MOT <- OFF;

     IF DETECT_COAST=TRUE THEN BEGIN;
        /* WATCH FOR MOTOR COAST */
        STAY LOOPING FOREVER;
           RACE;
              CASE NEXTIME EDGE#POS = PULSED;
                 RECEIVED@PULSES <- RECEIVED@PULSES + 1;
              CASE COAST_TIME;
                 EXIT STAY;
           END;
        RELOOP;
     END;

   OPTIMIZE 3;

   RETURN;
END;
```

LEGEND

| | |
|---|---|
| = : | Equal |
| != : | Not equal |
| Shutter: | 120 |
| Interlocks: | Various sensors positioned to assure various machine parts in safe operating condition, i.e. doors closed, etc. |
| HOME SWITCH: | 135 |
| EDGE MOTDR: | Shutter drive motor 125 |
| MAIN: | Main Paper Tray 25 |
| AUX: | Auxiliary Paper Tray 27 |

TABLE II

```
GLOBAL PROCEDURE POSITION_SHUTTER (INPUT@COMMAND:BYTE);

FUNCTION:          TO CONTROL THE POSITION OF THE EDGE FADEOUT
                   SHUTTER IN RELATION TO PAPER SIZE IN EACH
                   FEED TRAY.
```

```
DESCRIPTION:      THE EDGE FADEOUT SUBSYSTEM IS USED TO ERASE
                  THE CHARGE ON THE PHOTORECEPTOR IN THE AREA
                  BETWEEN THE PHOTORECEPTOR EDGE AND THE IMAGE
                  EDGE, BY POSITIONING A SHUTTER OVER THE
                  DESIRED IMAGE AREA, AS IT PASSES AN EDGE
                  FADEOUT LAMP, EXPOSING THE UNCOVERED AREA TO
                  LIGHT, THUS "ERASING" ANY CHARGE ON IT.

STARTED BY:       SHUTTER_RELAY - WHEN EFO IS REQUIRED
PASSED:           DESIRED@POSITION
RETURNS:          NOTHING
*/
```

TABLE III

EDGE FADEOUT SHUTTER CONTROL - SHUTTER_RELAY

```
/*******************************/
/* MAIN PROCEDURE STARTS HERE */
/*******************************/

OPTIMIZE 1;

GET_PAPER_SIZE (MAIN) RETURNS MNLNGTH,MNWIDTH;
GET_PAPER_SIZE (AUX)  RETURNS AXLNGTH,AXWIDTH;

GET_PAPER_SIZE (SELECTEDTRAY) RETURNS PAPER@LENGTH, PAPER@WIDTH;

IF (NO_REDUCTION)\(NO_PARK_SHUTTER) THEN BEGIN;
   IF (PARK_SHUTTER) THEN BEGIN;
      DESIRED@POSITION <- B4@POSITION;
   END; ELSE BEGIN;
      DETERMINE_DESIRED_POSITION;
   END;
   IF (FROM_START)\(VALID_REQUEST) THEN BEGIN;
      IF (GO_BUSY) THEN START STATE_HANDLER (GOBUSY\EDGESHUTTERSTATE);
      IF (LOW_PRIORITY) THEN SUSPEND_FOR 2 SEC;
      START POSITION_SHUTTER (DESIRED@POSITION);
   END;
END;
/* END OF MAIN PROCEDURE */
```

TABLE IV

EDGE FADEOUT SHUTTER CONTROL - SHUTTER_RELAY

```
LOCAL PROCEDURE DETERMINE_DESIRED_POSITION;
/*

FUNCTION:        TO CALCULATE THE ABSOLUTE CAM POSITION, IN UNITS OF
                 ENCODER PULSES, FOR THE ENTERED PAPER LENGTH.

USES:            PAPER@LENGTH - A BYTE WIDE VARIABLE INDICATING THE
                     LENGTH OF THE COPY SUBSTRATE, IN MILLIMETERS, MINUS
                     A CONSTANT OFFSET OF 128MM.
                 SELECTED@MAG@LEVEL - A BYTE WIDE VARIABLE, MAINTAINED BY
                     THE MAGNIFICATION MODULE, WHICH INDICATES THE CURRENT
                     IMAGE SIZE.

TYPICAL VALUES:
```

| SIZE | MM | ADJ MM | POSITION |
|---|---|---|---|
| HOME | | | 0 |
| 10.00" | 254 | 126 | 4 |
| 10.12" | 257 | 129 | 5 |
| 10.50" | 266 | 138 | 10 |
| 11.00" | 279 | 151 | 16 |
| 11.69" | 297 | 169 | 24 |
| 12.40" | 314 | 186 | 33 |
| 13.00" | 330 | 202 | 40 |
| 14.00" | 356 | 228 | 52 |
| 14.09" | 358 | 230 | 53 |
| 14.33" | 364 | 236 | 56 |

```
*/
DECLARE
   PROCEDURE MULTIPLY_WORD (BYTE,BYTE,BYTE,BYTE) RETURNS (BYTE,BYTE);
DECLARE
   SELECTED@MAG@LEVEL              EXTERNAL RO RAM BYTE VARIABLE;
DECLARE
   B4@POSITION                     GLOBAL   RO NOMEM BYTE CONSTANT VALUE=56;
DECLARE
   WHOLE                           SAME_AS 'TEMP1',
   FRACTIONAL                      SAME_AS 'TEMP0',
   PAPER@SIZE                      SAME_AS 'TEMP1';
DECLARE
```

```
    MAG@PAPER(20)  LOCAL RO ROM BYTE CONSTANT VALUE=(
       235,230,226,222,217,213,209,          /* THESE NUMBERS CORRESPOND TO */
       204,200,196,191,187,183,179,          /* TO REDUCTION VALUES OF 84%  */
       174,170,166,161,157,153);             /* DOWN TO 65% INCLUSIVE       */
 ENTER;

    /* THIS PROCEDURE USES IMPLIED DIVISION (THROW AWAY THE LSB) */

    BEGIN; /* CALCULATE MAG ERASE OFFSET */
       PAPER@SIZE <- PAPER@LENGTH; /* PUT IN REAL PAPER LENGTH */
       IF SELECTED@MAG@LEVEL<85 THEN BEGIN; /* REDUCTION IS IN USE */
          TEMP0 <- MAG@PAPER(84-SELECTED@MAG@LEVEL); /* GET OTHER PAPER SIZE */
          IF TEMP0<PAPER@SIZE THEN PAPER@SIZE <- TEMP0; /* USE SMALLER SIZE */
       END;
    END;

    /* EQUATION: Y = .47X - 55 */
    MULTIPLY_WORD (0,121,0,PAPER@SIZE) RETURNS WHOLE,FRACTIONAL;
    DESIRED@POSITION <- WHOLE - 55;

    RETURN;
 END;
```

TABLE V

EDGE FADEOUT SHUTTER CONTROL - POSITION_SHUTTER

```
/*******************************/
/* MAIN PROCEDURE STARTS HERE */
/*******************************/
IF SEQUENTIAL@FAULTS<MAXFAILURES THEN BEGIN;
   IF REM@RESET=NORMAL THEN BEGIN; /* DON'T SEND IF REMOTE IS DOWN */
      IF INPUT@COMMAND=HOMECYCLE THEN BEGIN;
         SHUTTER@POSITION <- MAXIMUM_POSITION;
         DESIRED@POSITION <- 84@POSITION;
      END; ELSE BEGIN;
         DESIRED@POSITION <- INPUT@COMMAND;
      END;
      IF DESIRED@POSITION<SHUTTER@POSITION THEN SEEK_HOME; ELSE HOME@LOST<-FALSE;

      IF HOME@LOST=FALSE THEN BEGIN;
         REQUIRED@PULSES <- DESIRED@POSITION - SHUTTER@POSITION;
```

```
            IF REQUIRED@PULSES>SELECTED_TOLERANCE THEN BEGIN;
               START STATE_HANDLER (GOBUSY\EDGESHUTTERSTATE);
               MOVE_SHUTTER;
               SHUTTER@POSITION <- SHUTTER@POSITION + RECEIVED@PULSES;
            END;
         END;
      END;
   END;

   START STATE_HANDLER (GOREADY\EDGESHUTTERSTATE);

   /* END MAIN PROCEDURE */
END;
```

TABLE VI

EDGE FADEOUT SHUTTER CONTROL - POSITION_SHUTTER

```
ENTER;
   LOCAL PROCEDURE MOVE_SHUTTER;
   /*

FUNCTION:          TO MOVE THE EDGE FADEOUT SHUTTER FROM THE CURRENT
                   POSITION TO THE DESIRED POSITION.
USES:               SHUTTER@POSITION - A BYTE WIDE VARIABLE IN THE RANGE
                     OF 0-56 (IN UNITS OF ENCODER PULSED) INDICATING THE
                     POSITION OF THE SHUTTER ON THE CAM.
*/
   ENTER;
      RECEIVED@PULSES <- 0;
      START FAULT_MANAGER (EFSFAULT,1,FAULTCLEAR);

      OPTIMIZE 1;
      EDGE$MOT <- ON;
      SEEK BEGIN;
         KEEP LOOPING UNTIL RECEIVED@PULSES >= REQUIRED@PULSES;
            RACE;
               CASE NEXTIME EDGE#POS = PULSED;
                  RECEIVED@PULSES <- RECEIVED@PULSES + 1;
               CASE TOO_LONG_FOR_NEXT_PULSE;
                  /* ERROR -- NO PULSE RECEIVED FROM EDGE#POS IN TIME LIMIT -- */
```

```
                IF INTERLOCKS_CLOSED THEN BEGIN;
                   START DECLARE_FAULT (EFSFAULT);
                   START INCREMENT_COUNTER (EFS@FAULT@CNT);
                   SEQUENTIAL@FAULTS <- SEQUENTIAL@FAULTS + 1;
                   EXIT SEEK;
                END;
```

TABLE VI (Pg. 2)

EDGE FADEOUT SHUTTER CONTROL - POSITION_SHUTTER

```
         END;
      RELOOP;
      SEQUENTIAL@FAULTS <- 0; /* POSITION OK .. CLEAR FAULT COUNTER */
   END;
   EDGE$MOT <- OFF;

     IF DETECT_COAST=TRUE THEN BEGIN;
        /* WATCH FOR MOTOR COAST */
        STAY LOOPING FOREVER;
           RACE;
              CASE NEXTTIME EDGE#POS = PULSED;
                 RECEIVED@PULSES <- RECEIVED@PULSES + 1;
              CASE COAST_TIME;
                 EXIT STAY;
           END;
        RELOOP;
     END;

   OPTIMIZE 3;

   RETURN;
END;
```

I claim:

1. In a reproduction machine, the combination of:

(a) a movable photoreceptor providing an imaging area of predetermined size;

(b) means for charging said photoreceptor in preparation for imaging;

(c) a platen for supporting a document to be copied;

(d) lamp means for exposing said platen and the document thereon;

(e) optical means for optically coupling said platen with said photoreceptor so that on actuation of said lamp means, the document on said platen is exposed and a latent electrostatic image of said document is created on said photoreceptor for development and transfer to a copy sheet, (f) reduction means for adjusting said optical means to permit the size of the latent image created on said photoreceptor to be changed;

(g) first and second erase means for discharging any non-image area of said photoreceptor when said latent image is smaller than said imaging area, said first erase means comprising a reflective cover for covering said platen and the document thereon, said cover reflecting light from said lamp means striking said cover onto said photoreceptor for discharging said non-image area;

said second erase means exposing said photoreceptor to discharge said non-image area; and (h) control means for controlling said first and second erase means to erase said non-image area, said control means inhibiting operation of said second erase means when said first erase means cover is closed, said control means enabling operation of said second erase means when said first erase means cover is open or when said first erase means cover is closed and said latent image is changed by said reduction means.

2. The reproduction machine according to claim 1 in which said second erase means includes a second lamp for exposing said photoreceptor, and movable shutter means for varying the area of said photoreceptor exposed by said second lamp, said control means including means for automatically moving said shutter to adjust the area of said photoreceptor exposed by said second lamp in response to the size of said copy sheet when said copy sheet is smaller than said latent image or in response to the size of said latent image when said latent image is smaller than said copy sheet.

3. The reproduction machine according to claim 2 in which said cover comprises an automatic document handler.

4. The reproduction machine according to claim 3 in which said document handler has at least one document feeding device, aperture means in said cover to enable said feeding device to engage said document, and auxiliary cover means for covering said aperture means during exposure whereby to provide a substantially uninterrupted reflective surface.

5. In a reproduction machine, the combination of:

a photoreceptor, a platen for supporting a document page to be copied, at least one exposure lamp for exposing said platen and the document page thereon, means forming an optical path for transmitting image rays from the document page on said platen to said photoreceptor to form a latent electrostatic image of the document page on said photoreceptor, a platen cover adapted when closed to overlay said platen and the document page thereon, the interior of said cover comprising a substantially uninterrupted reflective material adapted to reflect any light from said exposure lamp escaping around the document page on said platen through said optical means onto said photoreceptor whereby to at least discharge any non-image area adjacent the top and bottom edges of said latent electrostatic image, and edge erase means providing a pair of spaced erase beams of predetermined width to discharge the side edges of said photoreceptor and prevent developing thereof, said cover cooperating with said edge erase means to discharge any non-image area between said photoreceptor side edges and the top and bottom edges of said latent image, shutter means for adjusting the width of at least one of said erase beams whereby to vary the size of the corresponding photoreceptor side edge discharged; and means responsive to disposition of said cover in a non-operating position to move said shutter means and adjust the width of said one erase beam in accordance with the size copy sheet in use whereby said erase beams discharge both said photoreceptor side edges together with any non-image area between said photoreceptor side edge and the top and bottom edges of said latent image.

6. The reproduction machine according to claim 5 including shutter means for adjusting the width of at least one of said erase beams whereby to vary the size of the corresponding photoreceptor side edge discharged;

means for reducing the size of said latent image selectively, reduction in the size of said latent image effecting a corresponding increase in the size of said non-image area between said photoreceptor side edges and the top and bottom edges of said latent images; and means for moving said shutter means to adjust the width of said erase beams in accordance with size copy sheet in use or the size of said latent image whereby said erase beams discharge both said photoreceptor side edges together with any non-image area between said photoreceptor side edges and the top and bottom edges of said reduced latent image.

* * * * *